United States Patent [19]

Ahlstone

[11] 4,030,544

[45] June 21, 1977

[54] WELLHEAD SEAL APPARATUS AND PULLING TOOL FOR RELEASING AND RETRIEVING SUCH APPARATUS

[75] Inventor: Arthur G. Ahlstone, Ventura, Calif.

[73] Assignee: Vetco Offshore Industries, Inc., Ventura, Calif.

[22] Filed: Nov. 24, 1975

[21] Appl. No.: 634,366

Related U.S. Application Data

[62] Division of Ser. No. 475,586, June 3, 1974, Pat. No. 3,944,273.

[52] U.S. Cl. ..... 166/182; 166/217

[51] Int. Cl.[2] ..... E21B 23/00

[58] Field of Search ..... 166/123, 208, 217, 87, 166/182; 294/86.15, 86.18, 86.24, 86.34; 285/18

[56] References Cited

UNITED STATES PATENTS

| | | | |
|---|---|---|---|
| 2,571,478 | 10/1951 | Otis | 166/217 |
| 2,698,056 | 12/1954 | Marshall et al. | 166/217 |
| 3,150,718 | 9/1964 | Crowe | 294/86.25 |
| 3,250,331 | 5/1966 | Boyle | 166/217 |
| 3,698,756 | 10/1972 | Groves | 294/86.25 |
| 3,827,488 | 8/1974 | Piazza | 166/208 |

*Primary Examiner*—James A. Leppink

[57] ABSTRACT

A seal apparatus adapted to be set in packed-off condition in the annular region between the hanger body and the surrounding wellhead housing disposed at the upper end of a well bore, the seal apparatus then being locked in its packed-off condition by a locking ring and a locking ring actuator. A retrieving tool is employed to release the lock ring, such tool having resilient fingers engageable with the actuator to elevate it from wedging relation to the lock ring and permitting the latter to expand from its locked condition, whereupon the retrieving tool can elevate the seal apparatus, lock ring, and actuator from the region between the hanger body and wellhead housing. The retrieving tool includes a body having passages from which washing fluid can discharge to clean the region between the hanger body and wellhead housing. In one form of retrieving tool, the resilient fingers may be released from the actuator in response to fluid pressure supplied through a running string secured to the retrieving tool.

11 Claims, 8 Drawing Figures

WELLHEAD SEAL APPARATUS AND PULLING TOOL FOR RELEASING AND RETRIEVING SUCH APPARATUS

This is a division of application Se. No. 475,586, filed June 3, 1974, now U.S. Pat. No. 3,944,273.

The present invention relates to well apparatus, and more particularly to a seal apparatus which has been set and locked in packed off condition in the region between a hanger body and a surrounding wellhead housing disposed at the upper end of a well bore, and a retrieving tool for unlocking the apparatus and removing it from the region between the hanger body and wellhead housing.

In the drilling of oil and gas wells at an underwater location, a casing string is run into a well bore, the casing string being supported by a hanger body resting on a companion seat in a surrounding wellhead. The casing string is cemented in place and a suitable packing or seal assembly actuated to packoff the annular region between the hanger body and wellhead.

As disclosed in my co-pending application Ser. No. 474,019, filed May 28, 1974, the packing assembly is lowered from a drilling barge into position within the wellhead through use of a running string secured to a running and setting tool releasably connected to the packing assembly. The running string is weighted by the use of heavy drill collars below or above the running and setting tool to initially deform the packing in the annular space between the casing hanger and wellhead housing, and fluid under pressure can be applied to test the efficacy of the seal. Such applied fluid pressure also provides a force tending to effect further deformation of the packing, if necessary or possible. Fluid pressure is also operable on the setting and running tool to effect the locking of a wedge-lock device which prevents the packing from recovering and breaking the seal. Thereafter, the running and setting tool is released from the packing and wedge-lock device for recovery or retrieval to the drilling rig.

More particularly, the wedge-lock device for holding the packing packed off comprises a normally expanded resiliently contractable locking ring engageable with a tapered shoulder externally of the casing hanger body and a wedge ring normally held in a position allowing the lock-ring to be in its expanded position, but releasable to be moved axially to circumferentially deform the lock ring inwardly into locking co-engagement with a locking recess or tapered shoulder of the casing hanger. The wedge ring and the lock ring have cooperative locking wedge surfaces whereby the locking action is maintained to hold the packing in a packed off condition.

In the event it becomes necessary to release the packing a the locking wedge ring is provided with a pulling collar having a downwardly facing fishing shoulder whereby the wedge ring can be pulled from its locking position by an appropriate pulling or retrieving tool.

The present invention provides a retrieving tool adapted to be connected to a running pipe string and lowered into engagement with the pulling collar of the locking wedge ring of the packing apparatus to pull the wedge ring free from locking engagement with the lock ring of the packing apparatus to enable the apparatus to be retrieved.

In addition, the retrieving tool has ports communicating with the running string and jet nozzles to enable washing or flushing of the locking mechanism when desired or necessary.

The retrieving tool has a plurality of circumferentially spaced flexible fingers having lugs at their lower ends automatically engageable with the pulling collar of the wedge-lock ring when the tool is lowered into the wellhead, so that an upward pull on the running string will pull the wedge ring upwardly to release the lock. The packing is carried by a supporting sleeve with which the wedge ring is associated, and the supporting sleeve has a shoulder engageable by the wedge ring so that continued upward movement of the running string will pull the packing free for retrieval with the retrieving tool when the running string is pulled to the rig at the top of the water.

In one form the flexible fingers of the pulling tool are integral with a supporting ring connected to the running tool body by a retainer ring. In the event that the wedge locking ring cannot be pulled free from its locking position the retainer ring may be sheared to enable retrieval of the retrieving tool. In another form the retrieving tool has fluid pressure operated actuator means selectively operable to actuate the pulling tool fingers from engagement with the pulling collar of the wedge-lock ring so that the retrieving tool may be retrieved along with the flexible fingers in the event that the wedge-lock ring and packing cannot be pulled free.

This invention possesses many other advantages, and has other purposes which may be made more clearly apparent from a consideration of the forms in which it may be embodies. These forms are shown in the drawings accompanying and forming part of the present specification. They will now be described in details, for the purpose of illustrating the general principals of the invention; but it is to be understood that such detailed description are not to be taken in a limiting sense.

Referring to the drawings.

In the drilling and completion of wells, such as oil and gas wells, from vessels on a body of water, the blowout preventer equipment and casing hanger equipment are located and supported in a base mounted on the floor of a body of water. The well casing is supported by a wellhead housing, and a marine riser pipe extends downwardly from the vessel to the blowout preventer which is connected to the wellhead housing, all as is well known.

Figure 1:
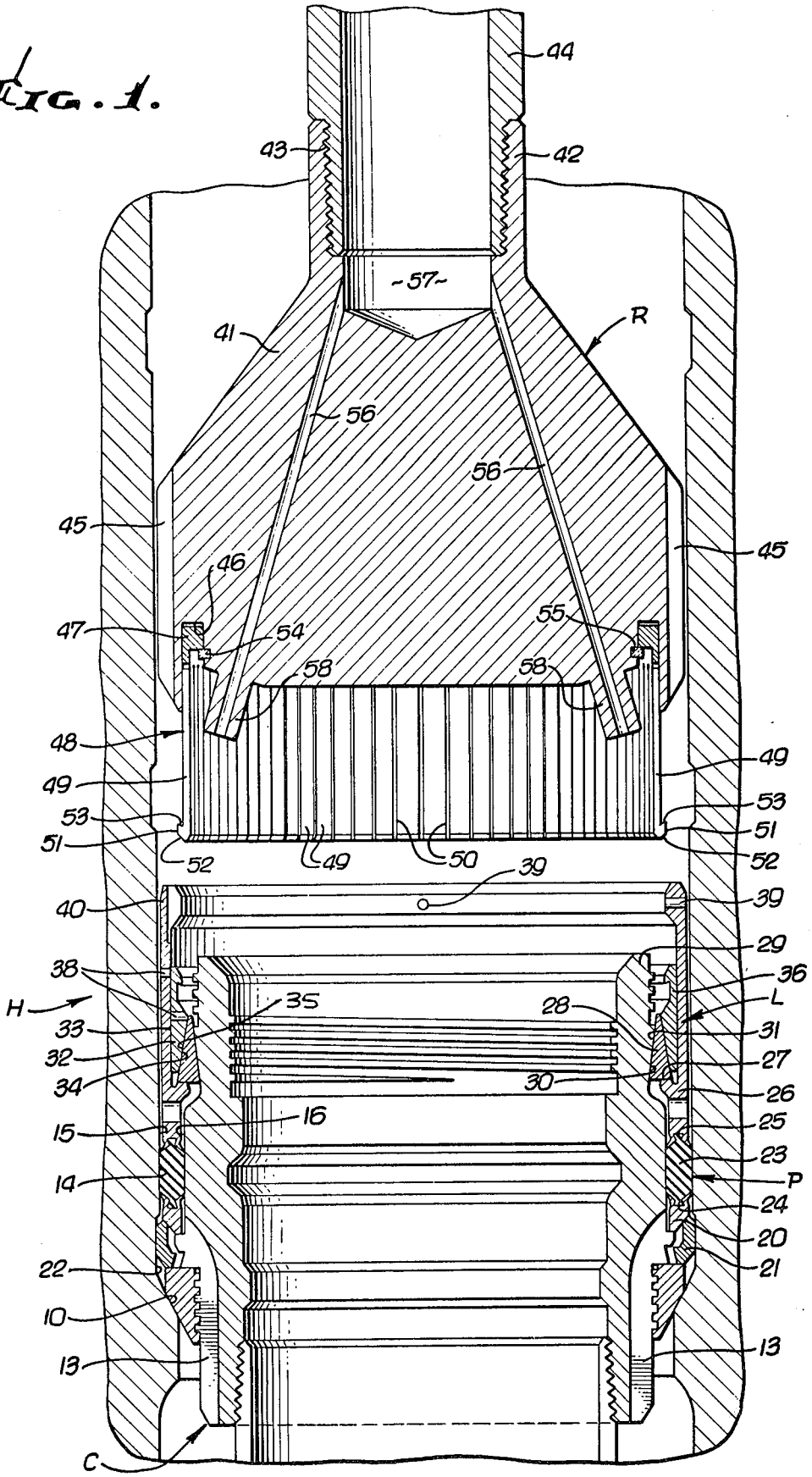
FIG. 1 is a view in vertical section, showing a wedge locked packing positioned between a casing hanger and a wellhead housing, with one form of a retrieving tool disposed in the wellhead housing prior to engagement with the locking wedge means.
Figure 2:
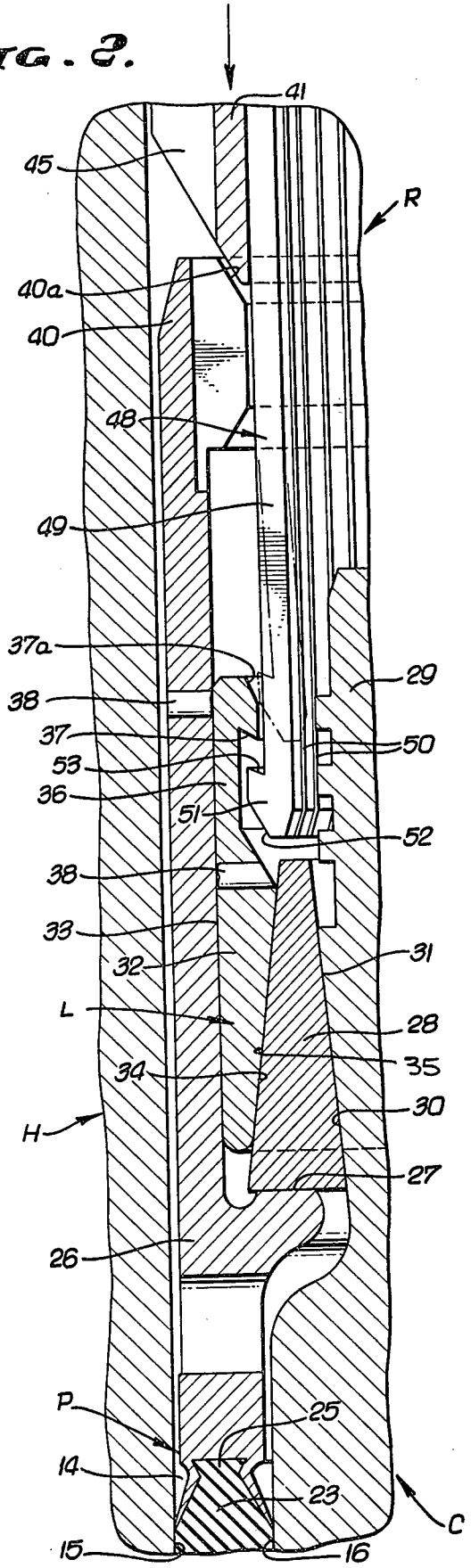
FIG. 2 is an enlarged fragmentary view in vertical section, showing, in full lines, the pulling tool lowered for engagement with the locking wedge ring, and showing, in broken lines, the fingers being cammed inwardly to pass the pulling collar.
Figure 3:
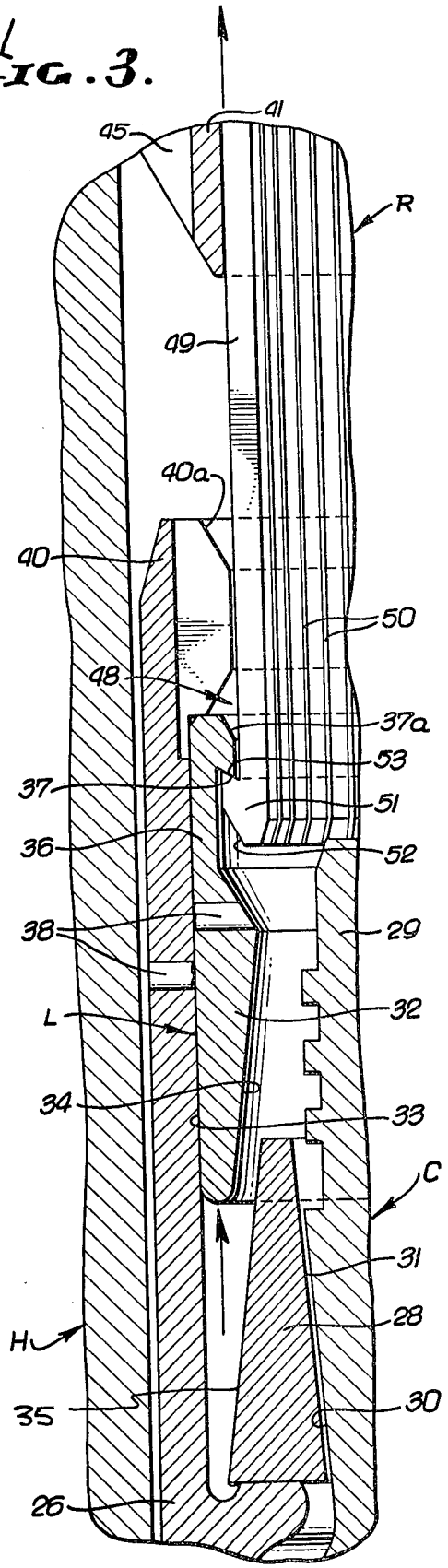
FIG. 3 is a view generally corresponding to FIG. 2, but showing the pulling tool elevated for engagement with the pulling neck of the locking wedge ring.
Figure 4:
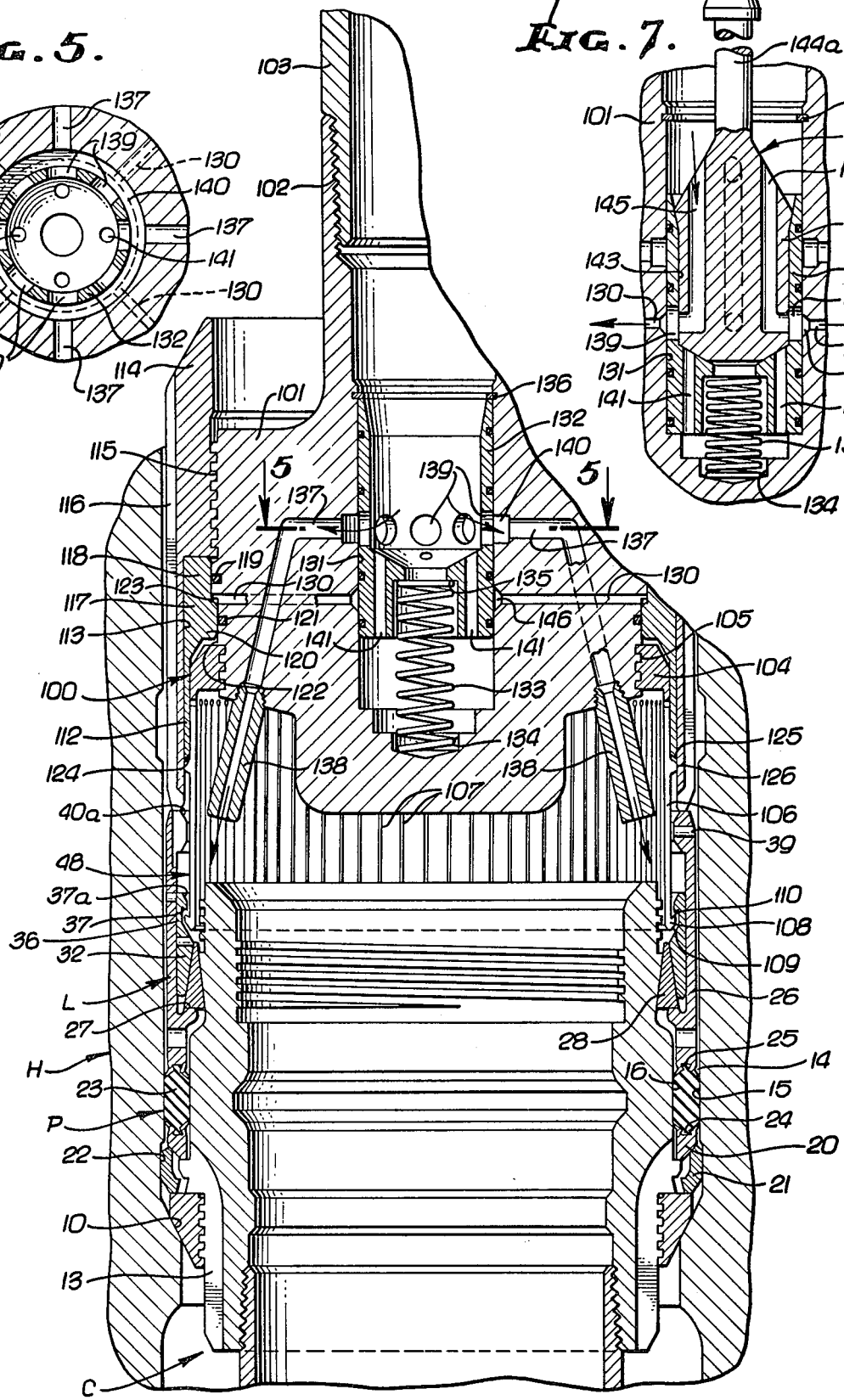
FIG. 4 is a view in vertical section, showing another form of pulling tool disposed in the wellhead housing and positioned for engagement with the pulling collar of the wedge-lock ring.
Figure 5:
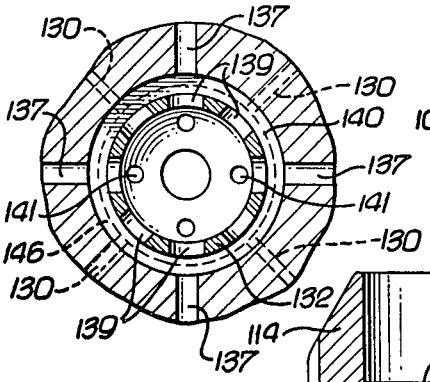
FIG. 5 is a fragmentary detail view in section, as taken on theline 5—5 of FIG. 4.

As seen in the drawings, referring first to the embodiment of FIGS. 1 through 3, the wellhead housing H has a casing hanger body C landed therein and supported upon an upwardly facing seat or shoulder 10. The casing hanger C has suitable passages 13 whereby circulating and cementing operations can be conducted in the usual manner by the displacement of cement downwardly through the casing, fluid in the well being displaced upwardly through the passages 13 and through an annular space 14 defined between the cylindrical inner wall 15 of the housing H and the opposing cylindrical wall 16 of the casing hanger C.

A seal is formed between the opposing cylindrical walls 15 and 16, after the cementing operation is completed, by setting a packing P in the annular space 14 in sealing engagement between the opposing cylindrical walls 15 and 16 and securely locking the packing in packed off condition by locking means L, the packing means P and the locking means L being lowered from the drilling vessel on a running and setting tool (not shown) which is connected to a running pipe string. Suitable running and setting tools for running and setting the packing P in the annulus 14 and actuating the locking means L to the illustrated packed off and locked condition are shown and described in my copending application for U.S. Ser. No. 474,019, filed May 28, 1974.

The packing P is shown in a packed off condition and includes a lower abutment ring or collar 20 which is in abutting engagement with a split-lock ring 21 shown as expanded outwardly into a locking groove 22 in the housing H, whereby the casing hanger C is locked in the housing H, as is customary. In addition, the packing P includes an annular body 23 of resiliently deformable elastomeric sealing material connected by a dove-tailed connection 24 to the lower ring 20, and by a corresponding upper dove-tailed connection 25 with a packing support sleeve 26. The packing body 23 is deformable outwardly and inwardly into sealing engagement with the opposed cylindrical walls 15 and 16, respectively, of the housing H and the casing hanger C upon axial deformation of the packing body. Such a packing is more fully disclosed in U.S. Pat. No. 3,797,864, granted Mar. 18, 1974, for "Combined Metal and Elastomer Seal."

The packing support sleeve 26, at a location above the packing 23, has an internal upwardly facing shoulder or seat 27 on which rests a split resilient lock ring 28 which is normally of such diameter as to pass downwardly over the upwardly extended annular section 29 of the casing hanger C. This casing hanger section 29 is undercut on its outer periphery at 30 to provide a groove, or, as shown in this specific embodiment, a downwarldy and inwardly tapered annular surface adapted to receive the correspondingly downwardly and inwardly tapered side 31 of the lock ring 28, when the latter is deformed inwardly from its normally expanded condition to its contracted or locking position. In order to effect locking contraction of the lock ring 28 a lock ring actuator 32 is provided. This lock ring actuator is in the form of an annular wedge having an outer cylindrical wall 33 slidably disposed within the packing support sleeve 26 and an inner downwardly and outwardly tapered wedge surface 34 opposed to and engageable with the outer downwardly and outwardly tapered surface of the lock ring 28, whereby upon downward movement of the actuator 32 within the support sleeve 26, the lock ring 28 will be wedged or cammed circumferentially inwardly to the locking position with the locking surface 30 of the casing hanger C. The angles of the surfaces 34 and 35 of the actuator or wedge locking ring 32 and the lock ring 28, respectively, are selected to be locking wedge angles, so that once the wedge action has deformed and locked the lock ring 28 in place, the actuator 32 must be forcefully retracted before the lock ring can be released. Accordingly, the actuator 32 has an internally undercut neck 36 at its upper extremity and an internal fishing or retrieving shoulder or collar 37 adapted to be engaged by a pulling tool, such as the wedge-lock pulling tool hereinafter to be described.

During the lowering of the packing and the locking assembly through the riser pipe and into the wellhead housing H, and during the initial packing off of the packing P, the actuating wedge 32 is held in an upper inoperative position by releasable means such as one or more shear pins 38 which interconnect the actuator 32 to the packing support sleeve 26. These shear pins are selected so that they will retain the actuator 32 in the initial position until the packing is fully set, and a downward force is applied to the actuting wedge 32 to shear the pins 38 enabling downward locking movement of the actuator wedge 32. Shear pins 38 initially connect the upper end 40 of the packing support sleeve 26 to the running and setting tool and are sheared when the setting and running tool is retrieved.

The retrieving tool R, in accordance with one form of the invention, comprises a body 41 having an upper hollow neck 42 threadedly connected at 43 to the lower end of a pipe string 44 which constitutes an operating string extending to the rig and on which the retrieving tool R is adapted to be lowered through the riser pipe into the wellhead housing H and into engagement with the packing and locking apparatus previously described, to release and pull the same. The body 41 is of such a size as to center the body within the housing H and has longitudinally extended fluid by-pass passages 45 at circumferentially spaced locations about the body to enable it to freely pass downwardly through fluid in the housing. Formed in the body 41 is a downwardly opening annular groove 46 in which is received an upper solid ring section 47 of flexible collett or finger means 48. Such finger means 48 includes a plurality of circumferentially spaced downwardly extended fingers 49 integral with the supporting ring section 47, and separated by longitudinally extended slots 50. At the lower end of each finger 49 is an outwardly projecting lug 51 having a lower downwardly and inwardly inclined cam surface 52 and an upper downwardly and inwardly inclined shoulder 53. To support the ring section 47 within the groove 46 in the body 41 a retainer ring 54 is disposed in an annular groove 55 in the body 41 and engages beneath the ring section 47.

As seen in FIG. 2, as the retrieving tool R is lowered downwardly into the packing supporting sleeve 26, a bevelled cam surface 40*a* is extended internally so that the upper end 40 of the sleeve 26 will deflect the fingers 49 inwardly upon contact of the lower cam surfaces 52 of the lugs 51 so that the fingers can pass downwardly into the sleeve 26. Thereafter, as seen in broken lines in FIG. 2, the lower cam surfaces 52 of the fingers 49 engage an upper and inner bevelled surface 37*a* at the top of the wedge locking ring 32, to again deflect the fingers 49 inwardly so that the lugs 51 are enabled to pass downwardly through the pulling collar or shoulder 37 of the wedge locking ring 32. When the lugs 51 pass below the shoulder 37, the fingers 49 can normally flex outwardly to dispose the lugs 51 beneath the shoulder 37, whereby upon upward movement of the retrieving tool R, as shown in FIG. 3, the upper ring lug surfaces 53 will interlock with the pulling shoulder 37 of the wedge-lock ring 32, whereby the latter will be pulled upwardly. When the wedge-lock ring 32 is pulled upwardly, the split lock ring 28 is freed so that it may expand outwardly, allowing the packing support sleeve 26 to then be pulled upwardly relative to the housing H and the casing hanger body C.

In the event that sediment or the like is so deposited about the wedge-lock ring 32 as to prevent its being pulled upwardly by the retrieving tool R, the body 41 is provided with means for enabling a washing fluid to be circulated downwardly through the pipe string 44 and upwardly through the body passages 45 to flush the sediment away. In this connection the body 41 has a suitable number of circumferentially spaced passages 56 leading from a chamber 57 at the juncture of the body with the pipe string 44, these passages 56 opening downwardly and outwardly through circumferentially spaced jet nozzles 58 which are directed towards the annular space 14 between the housing H and the casing hanger C in which the packing and lock means are received.

In the event that even after washing or flushing sediment from the apparatus, as just described, the locking wedge ring 32, nevertheless, cannot be pulled, the retainer ring 54 can be sheared by applying sufficient upward pull on the pipe string 44. Under these circumstances subsequent recovery operations can be performed.

In accordance with another form of the invention as shown in FIGS. 4 through 8, means 100 are provided whereby the latch fingers are retractable or disengageable from the pulling collar 37 of the lock-wedge ring 32. In this form, the retrieving tool has its body 101 threadedly connected at 102 to the lower end of the tubular pipe string 103. The flexible finger means 48 includes a support ring or body 104 threadedly connected at 105 to the body 101 and having the circumferentially spaced and downwardly extended flexible fingers or latch elements 106 separated by longitudinal slots 107. As in the previously described embodiment, each of the fingers 106 has at its lower end a lug 108 provided with a downwardly and inwardly inclined surface 109 engageable with the bevelled surfaces 40*a* and 37*a* on the sleeve 26 and the wedge-lock ring 32, to flex the fingers inwardly as the retrieving tool is lowered into the position of FIGS. 4 and 6. Each lug 108 on the fingers 106 also has the upwardly and outwardly inclined surface 110 engageable with the pulling collar or shoulder 37 on the wedge-lock ring 32 to apply an upward pull thereto, as in the case of the previously described embodiment.

The retracting means 100 fo releasing the latch lugs 108 from the pulling collar or shoulder 37 includes an actuator sleeve 112 reciprocably disposed in a bore 113 in an outer body section 114 which is threaded onto the main body 101 at 115, the outer body section 114 having fluid passages 116 extending longitudinally to enable the bypass of fluid about the body assembly.

At its upper end, the actuator sleeve 112 has a cylinder section 117 including an upper cylindrical end 118 slidably and sealingly engaged by an upper seal ring 119 carried on the body 101. A piston 120 on the cylinder section 117 has a reduced diameter and sealingly engages a lower seal ring 121 carried by a reduced section 122 of the body 101. Between the seals 119 and 121 is formed a chamber 123 to which fluid under pressure can be supplied, as later described, to force the actuator sleeve 112 downwardly to release the latch fingers 106. Downward movement of the actuator sleeve 112 releases the fingers 106 from the pulling shoulder 37 of the wedge-lock ring 32 by engagement of a lower end surface 124 on the actuator sleeve 112 which is inclined downwardly and outwardly and is engageable with an upwardly and inwardly inclined surface 125 on a lug 126 on each latch finger 106. The opposed surfaces 124 on the sleeve 112 and 125 on the finger lugs 126, upon downward movement of the actuator sleeve from the position of FIG. 6 to the position of FIG. 8, will be seen to flex the latch fingers 106 inwardly. Since the lugs 126 are located well above the lower ends of the latch fingers 106, only slight movement of the sleeve 112 is required to effect the necessary inward movement of the latch lugs 108 on the fingers 106 to the released position of FIG. 8.

As previously indicated, pressure applied to the piston chamber 123 is employed to force the actuator sleeve downwardly when desired. The body 101 has pressure fluid passages 130 leading to the piston chamber 123 from a bore 131 in the body 101. These passages 130 are normally closed by a valve sleeve 132 which is disposed in the bore 131 and normally held in an upper position (FIG. 4) by a coiled compression spring 133 which seats at its lower end in a seat 134 and engages in a seat 135 in the lower side of the valve sleeve 132. A split retainer ring 136 engaged in the body 101 limits upward movement of the valve 132 and retains it in the bore 131.

As in the case of the previously described embodiment, fluid can be circulated downwardly through the pipe string 103 and through passages 137 in the body 101, through nozzles 138, to wash sediment from the locking means L. In the present form, the valve sleeve 132 has a number of radial ports 139 leading to an annulus 140 in the tool body 101, and the washing passages 137 communicate with the annuls 140. The valve sleeve 132 has through passages 141 leading to the bore 131 below the valve sleeve so that the valve sleeve is balanced and is not shifted downwardly by fluid pressure during the washing operation.

Figure 7:
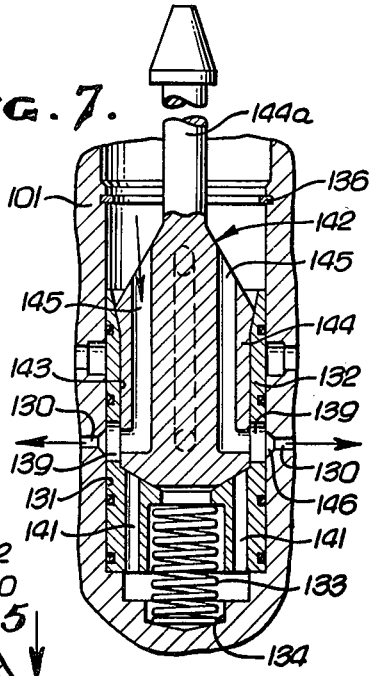
FIG. 7 is a fragmentary detail view in longitudinal section, showing a fluid pressure responsive dart set in the valve sleeve of FIG. 4.
Figure 6:
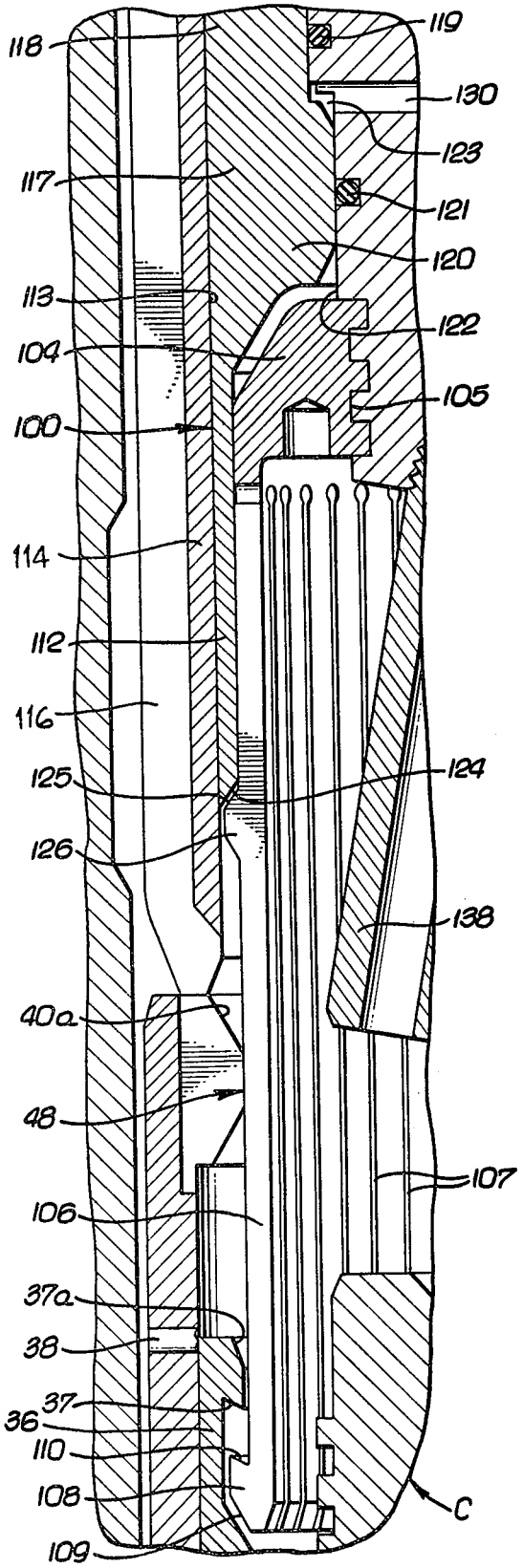
FIG. 6 is an enlarged fragmentary detail view, showing the pulling fingers, the pulling collar and the finger releasing means in the condition of FIG. 4.
Figure 8:
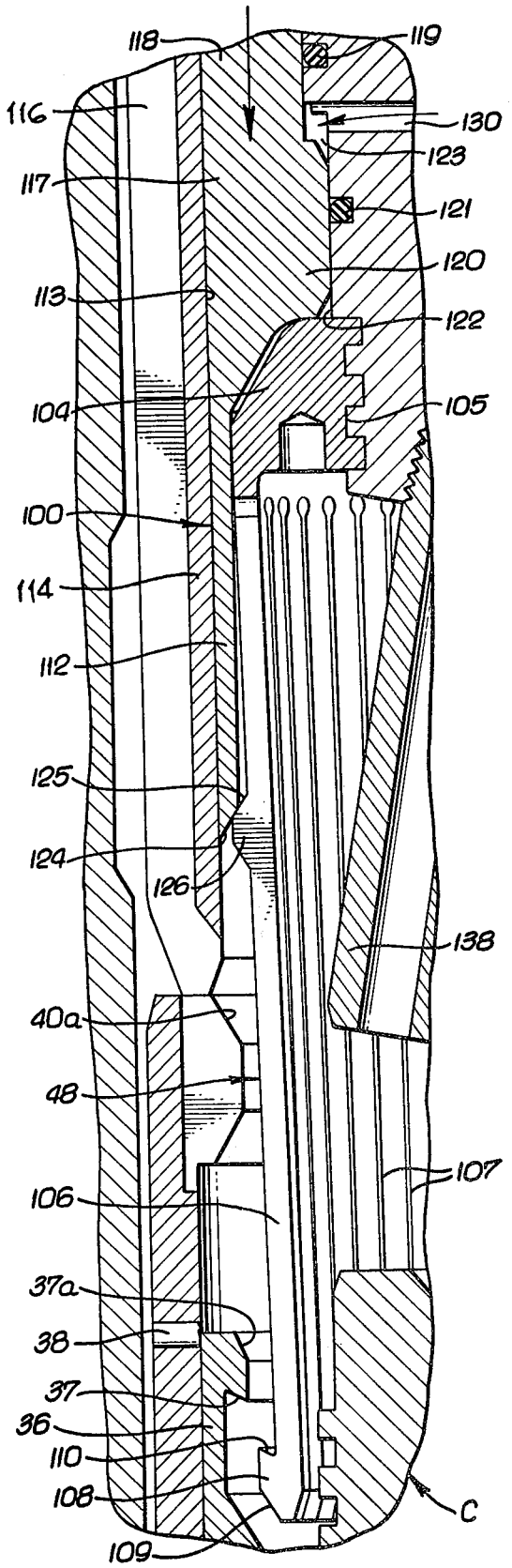
FIG. 8 is a view corresponding to FIG. 6, but showing the pulling fingers actuated to the released condition.

When and if it becomes necessary to establish communication between the bore 131, the pipe string 103 and the piston chamber 124, to release the fingers 106, as described above, the valve sleeve 132 is shifted downwardly to establish communication between the valve ports 139 and the body passages 130, as seen in FIG. 7. To accomplish this, a dart 142 is dropped into the pipe string 103 and seats in the bore 143 within the valve sleeve 132. The dart 142 has a body 144 which closely fits in the valve bore 143 and a retrieving neck 144a. As the dart enters the bore 143 during the flow of fluid through the valve sleeve 132, the flow is so shutoff or diminished that the pressure shifts the valve sleeve 132 downwardly and seats the dart in the bore 143, so that passages 145 in the dart communicate with the valve ports 139 which are then in communication with an annulus 146 which communicates with the ports 130 leading to the piston chamber 123 for actuating the latch release sleeve 112 downwardly. The entire retrieving tool can then be pulled from the housing H and other removal methods resorted to for removing the packing H.

I claim:

1. In seal apparatus between a wellhead and a hanger disposed in the wellhead for supporting a tubular pipe string extending into a well bore: packing means; locking means for locking said packing means in sealing relation to the hanger including a locking member actuable longitudinally to lock said locking means and retractable to release said locking means and packing means; said locking member having a circumferentially continuous pulling shoulder; and pulling tool means including instrumentalities deflectable inwardly by said locking member to enable said instrumentalities to move past said shoulder to a position therebelow, said instrumentalities deflecting outwardly under said shoulder for engagement with the underside of said shoulder to retract said locking member.

2. In seal apparatus as defined in claim 1, said pulling tool means including a body having means connectable to an operating pipe string for lowering said body and pulling upwardly on said body to retract said locking member.

3. In seal apparatus as defined in claim 1, said pulling tool means including a body having means connectable to an operating pipe string for lowering said body and pulling upwardly on said body to retract said locking member, said instrumentalies including circumferentially spaced flexible fingers having lugs projecting outwardly therefrom and engageable with said pulling shoulder.

4. In seal apparatus as defined in claim 1, said pulling tool means including a body having means connectable to an operating pipe string for lowering said body and pulling upwardly on said body to retract said locking member, said instrumentalities including circumferentially spaced flexible fingers having lugs projecting therefrom and engaged with said pulling shoulder, and including actuator means for flexing said fingers inwardly from latching relation with said pulling shoulder.

5. In seal apparatus as defined in claim 4, said body having fluid passage means leading from said pipe string to the vicinity of said latch means for conducting washing fluid to the vicinity of said packing and locking means.

6. In seal apparatus between a wellhead and a hanger disposed in the wellhead for supporting a tubular pipe string extending into a well bore: packing means; locking means for locking said packing means in sealing relation to the hanger including a locking member actuatable longitudinally to lock said locking means and retractable to release said locking means and packing means; said locking member having a pulling shoulder; and pulling tool means engageable with said shoulder for retracting said locking member, said pulling tool means including a body having means connectable to an operating pipe string for lowering said body and pulling upwardly on said body, and latch means carried by said body and engaged with said pulling shoulder, said body having fluid passage means leading from said pipe string to the vicinity of said latch means for conducting washing fluid to the vicinity of said packing and locking means.

7. In seal apparatus between a wellhead and a hanger disposed in the wellhead for supporting a tubular pipe string extending into a well bore: packing means; locking means for locking said packing means in sealing relation to the hanger including a locking member actuatable longitudinally to lock said locking means and retractable to release said locking means and packing means; said locking member having a pulling shoulder; and pulling tool means engageable with said shoulder for retracting said locking member, said pulling tool means including a body having means connectable to an operating pipe string for lowering said body and pulling upwardly on said body, and latch means carried by said body and engaged with said pulling shoulder, said latch means including circumferentially spaced flexible fingers having lugs projecting therefrom and engage with said pulling shoulder, and including means responsive to a predetermined pull on said body by said pipe string for releasing said latch fingers from said body.

8. In seal apparatus as defined in claim 7, said body having fluid passage means leading from said pipe string to the vicinity of said latch means for conducting washing fluid to the vicinity of said packing and locking means.

9. In seal apparatus between a wellhead and a hanger disposed in the wellhead for supporting a tubular pipe string extending into a well bore: packing means; locking means for locking said packing means in sealing relation to the hanger including a locking member actuatable longitudinally to lock said locking means and retractable to release said locking means and packing means; said locking member having a pulling shoulder; and pulling tool means engageable with said shoulder for retracting said locking member, said pulling tool means including a body having means connectable to an operating pipe string for lowering said body and pulling upwardly on said body, and latch means carried by said body and engaged with said pulling shoulder, said latch means including circumferentially spaced flexible fingers having lugs projecting therefrom and engaged with said pulling shoulder, a ring integral with said fingers, said body having an annular groove receiving said ring, and retainer means securing said ring in said groove.

10. In seal apparatus between a wellhead and a hanger disposed in the wellhead for supporting a tubular pipe string extending into a well bore: packing means; locking means for locking said packing means in sealing relation to the hanger including a locking member actuatable longitudinally to lock said locking means and retractable to release said locking means and packing means; said locking member having a pulling shoulder; and pulling tool means engageable with said shoulder for retracting said locking member said pulling tool means including a body having means connectable to an operating pipe string for lowering said body and pulling upwardly on said body, and latch means carried by said body and engaged with said pulling shoulder, said latch means including circumferentially spaced flexible fingers having lugs projecting therefrom and engaged with said pulling shoulder, actuator means carried by said body and shiftable relative to said fingers for flexing said fingers from latching relation with said pulling shoulder, said actuator means including a sleeve on said body and fluid pressure operated means for shifting said sleeve relative to said fingers, said fingers and said sleeve having coengageable surfaces for flexing said fingers.

11. In seal apparatus as defined in claim 10, said body having fluid passage means leading from said pipe string to the vicinity of said latch means for conducting washing fluid to the vicinity of said packing and locking means.

* * * * *